US009863253B2

(12) United States Patent
Hiernaux

(10) Patent No.: US 9,863,253 B2
(45) Date of Patent: Jan. 9, 2018

(54) AXIAL TURBOMACHINE COMPRESSOR BLADE WITH BRANCHES AT THE BASE AND AT THE HEAD OF THE BLADE

(71) Applicant: Techspace Aero S.A., Herstal (Milmort) (BE)

(72) Inventor: Stephane Hiernaux, Oupeye (BE)

(73) Assignee: Safran Aero Boosters SA (BE)

( * ) Notice: Subject to any disclaimer, the term of this patent is extended or adjusted under 35 U.S.C. 154(b) by 248 days.

(21) Appl. No.: 14/803,818

(22) Filed: Jul. 20, 2015

(65) Prior Publication Data

US 2016/0024932 A1 Jan. 28, 2016

(30) Foreign Application Priority Data

Jul. 22, 2014 (EP) ..... 14177991

(51) Int. Cl.
*F01D 5/14* (2006.01)

(52) U.S. Cl.
CPC ..... *F01D 5/146* (2013.01); *F05D 2240/30* (2013.01)

(58) Field of Classification Search
CPC ..... F01D 5/146; F01D 5/225; F01D 9/041; F05D 2240/30
See application file for complete search history.

(56) References Cited

U.S. PATENT DOCUMENTS 4,102,600 A * 7/1978 Schwab ..... F01D 5/145 416/231 R
4,687,416 A * 8/1987 Spranger ..... B64C 11/16 416/200 R
6,910,854 B2 * 6/2005 Joslin ..... F01D 5/225 415/139
7,396,208 B1 * 7/2008 Hussain ..... F01D 5/146 416/227 A
8,257,023 B2 * 9/2012 Belmonte ..... F01D 5/146 415/83
2014/0314556 A1 * 10/2014 Fremont ..... B29C 70/222 415/200
2015/0354377 A1 * 12/2015 Gimat ..... B29B 11/16 415/200

FOREIGN PATENT DOCUMENTS

FR 2914943 A1 10/2008
GB 2106193 A * 4/1983 ..... F01D 5/14
WO WO 2005040559 A1 * 5/2005 ..... F01D 5/146

OTHER PUBLICATIONS

European Search Report from corresponding European Application No. EP14177991.8, dated Sep. 24, 2014.

* cited by examiner

*Primary Examiner* — Woody Lee, Jr.
*Assistant Examiner* — Eric Zamora Alvarez
(74) *Attorney, Agent, or Firm* — Polster Lieder

(57) ABSTRACT

The invention relates to a blade of an axial turbomachine comprising an airfoil which extends radially and a first set of branches or divisions, which radially extend a radial end of the airfoil, and a second set of branches which radially extend the other of the radial ends of the airfoil and which are offset over the circumference of the turbomachine. The branches extend axially along the entire length of the airfoil. The sets have different numbers of branches. The branches further occupy the channel of the turbomachine and further counteract debris in the event of intake.

16 Claims, 4 Drawing Sheets

FIG 8
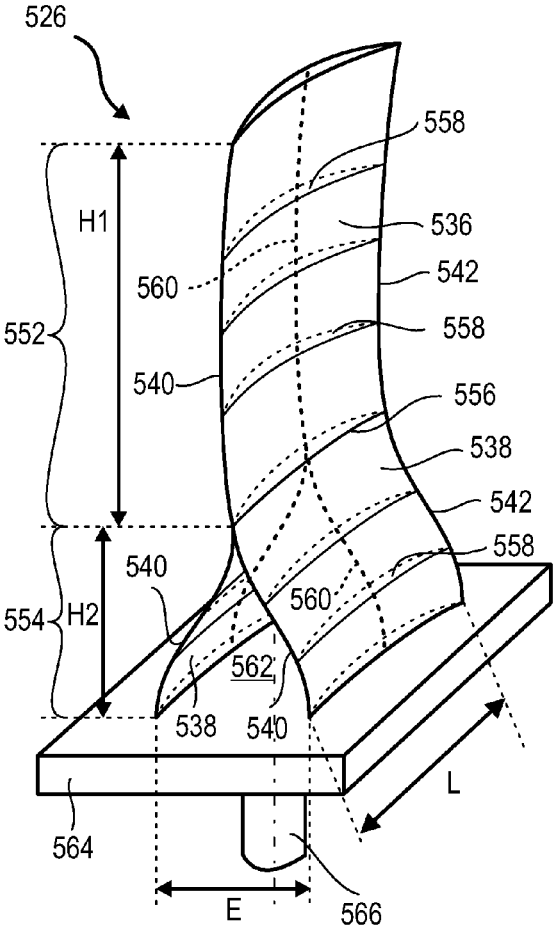
FIG 9
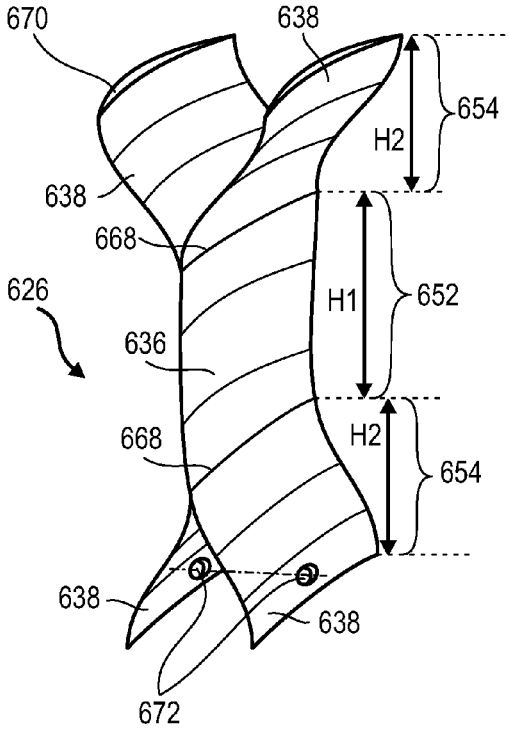
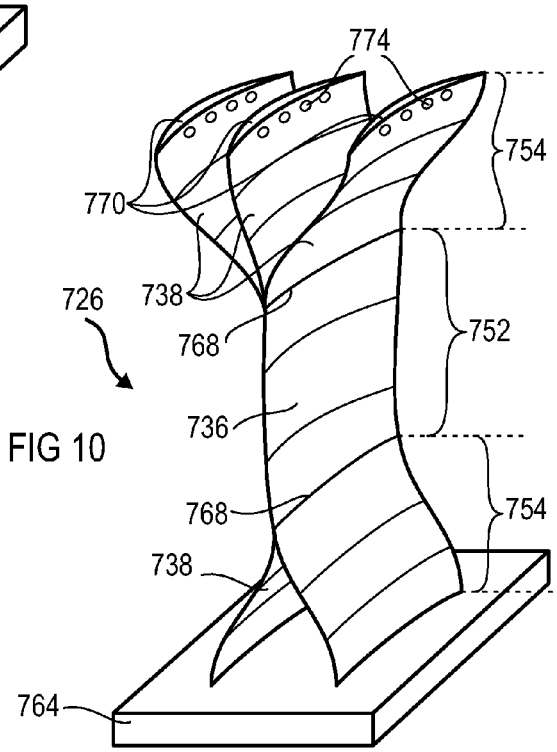
FIG 10

AXIAL TURBOMACHINE COMPRESSOR BLADE WITH BRANCHES AT THE BASE AND AT THE HEAD OF THE BLADE

CROSS-REFERENCE TO RELATED APPLICATIONS

This application claims the benefit, under 35 U.S.C. §119, of EP 14177991.8, filed Jul. 22, 2014, the disclosure of which is incorporated herein by reference in its entirety.

FIELD

The invention relates to a turbomachine blade. More specifically, the invention relates to a turbomachine blade which comprises branches. The invention also relates to a blading with a row of branched blades. The invention also relates to a turbomachine which comprises a blade having branches and/or a blading with a row of branched blades.

BACKGROUND

An axial turbomachine blade generally has a profiled airfoil which extends in the flow of the turbomachine. In order to reduce the number of blades in a row whilst retaining the performance levels, it is known to produce a blade with branches.

Document FR 2 914 943 A1 discloses an axial turbomachine ventilator blade. The blade comprises a first portion which extends from a hub of the ventilator, and a plurality of other portions which extend the first portion radially outwards. All these portions are connected by means of a platform which is arranged at the outer end of the first portion. However, this blade configuration has reduced rigidity. The presence of the platform at the centre of the channel can disturb the flow. During operation, the branches are subjected to vibrations and forces which can damage the blade. The blade has a large mass. The presence of the branches places a load on the platform; the mechanical strength thereof requires that it be made thicker, which disturbs the flow.

SUMMARY

An object of the invention is to overcome at least one of the problems posed by the prior art. More specifically, an object of the invention is to increase the rigidity of a turbomachine blade with branches. An object of the invention is also to make a turbomachine blading with branched blades more rigid. An object of the invention is also to protect the turbomachine in the event of intake.

The invention relates to an axial turbomachine blade comprising an airfoil which extends radially and which has two radially opposing ends, and a first set of branches which radially extend one of the ends of the airfoil, it further comprises a second set of branches which radially extend the other of the opposing ends of the airfoil and which are offset relative to each other over the circumference of the turbomachine.

According to various advantageous embodiments of the invention, the blade comprises a fixing support which is connected to a set of branches via the ends of the branches which are radially opposite the airfoil, in various instances it comprises a fixing support at each side of the airfoil, which support is connected to the airfoil via a set of branches.

According to various advantageous embodiments of the invention, opposite the airfoil, each branch of at least one set of branches at one end of the airfoil comprises a free portion, in various embodiments each free portion extends from the leading edge to the trailing edge of the corresponding branch.

According to various advantageous embodiments of the invention, at least one branch of the first set is superimposed radially on at least one branch of the second set, the branches being connected by the airfoil.

According to various advantageous embodiments of the invention, the branches of the first set extend at each side of the airfoil over the thickness thereof and completely cover the branches of the second set.

According to various advantageous embodiments of the invention, the sets of branches form rows of branches which are generally parallel, the branches of each set comprise mutually opposing faces.

According to various advantageous embodiments of the invention, the leading edge and the trailing edge of at least one branch of the first set have the same number of separate curved portions as the leading edge and the trailing edge of a branch of the second set, which branch is arranged radially opposite.

According to various advantageous embodiments of the invention, the first set and the second set comprise different numbers of branches, in various embodiments the branches of the set comprising more branches are connected at different radial heights.

According to various advantageous embodiments of the invention, the branches of the set which has more branches are less thick than the branches of the other set.

According to various advantageous embodiments of the invention, the blade comprises two branches at the inner end of the airfoil and three branches at the outer end of the airfoil, the sets have different spacings E between their branches.

According to various advantageous embodiments of the invention, at least one set comprises two side branches and at least one central branch, the at least one central branch extending over the extension of the stacking curve of the profiles of the airfoil.

According to various advantageous embodiments of the invention, at least one branch extends in the radial extension of the airfoil and is offset over the thickness of the airfoil, the branches at each end of the airfoil are generally inclined one relative to the other(s).

According to various advantageous embodiments of the invention, the branches of at least one or each set overlap axially over the majority of their lengths L, and each branch extends axially over the majority, e.g., over the whole of the airfoil, and the branches of at least one or each set are connected, the branches and the airfoil are integral and are produced by means of additive production based on metal powder.

According to various advantageous embodiments of the invention, the radial heights of the branches are different from one set to another.

According to various advantageous embodiments of the invention, the developed lengths of the leading edges and the trailing edges are different within the same end of the airfoil or from one end of the airfoil to another.

According to various advantageous embodiments of the invention, the angular spacings between the branches are different from one set to another.

According to various advantageous embodiments of the invention, the branches are offset from each other over the thickness of the airfoil.

According to various advantageous embodiments of the invention, the branches are aligned along the leading edges and/or along the trailing edges thereof.

According to various advantageous embodiments of the invention, the branches comprise connection edges which are at least partially merged in order to join the branches to each other along the airfoil.

According to various advantageous embodiments of the invention, the connection edges of the branches are connected over the majority, e.g., over all, of the lengths L thereof and/or the length of the chord of the airfoil.

According to various advantageous embodiments of the invention, the airfoil and/or the branches comprise leading edges and trailing edges, the leading edge of the airfoil being extended radially by the leading edges of the branches and/or the trailing edge of the airfoil being extended radially by the trailing edges of the branches.

According to various advantageous embodiments of the invention, the leading edges and the trailing edges of the branches are tangential to the leading edge and the trailing edge of the airfoil, respectively.

According to various advantageous embodiments of the invention, at least one or each branch has a height H2 which is greater than 5%, e.g., greater than 10%, e.g., greater than 20% of the height H1 of the airfoil.

According to various advantageous embodiments of the invention, the blade is a compressor blade, in various embodiments a low-pressure compressor blade, or a turbine blade, or a ventilator blade.

According to various advantageous embodiments of the invention, at the side of the airfoil, the branches converge towards each other over their height H2 and their length L.

According to various advantageous embodiments of the invention, the airfoil is divided over the thickness thereof into a plurality of branches.

According to various advantageous embodiments of the invention, the branches radially delimit the airfoil.

According to various advantageous embodiments of the invention, the blade is a rotor blade or a stator vane.

The invention also relates to a compressor comprising at least one blade and wherein at least one blade is in accordance with the various embodiments of the invention as described herein.

The invention also relates to a turbomachine which comprises at least one blade and wherein at least one blade is in accordance with the various embodiments of the invention as described herein. For example, in various instances the turbomachine comprises a compressor with rows of blades, at least one or each compressor blade being in accordance with the various embodiments of the invention as described herein.

According to various advantageous embodiments of the invention, the row of blades comprises two concentric shrouds or two concentric shroud segments and a plurality of blades extending radially between the shrouds, the shrouds being connected to each other via each set of branches.

Each advantageous embodiment of the invention can apply to the other objects of the invention. Each object of the invention can be combined with the other objects of the invention.

The invention enables the blade to be stiffened. This is because the branching airfoils form a corner at the end of the connection airfoil at locations where they are connected. The edge of the connection airfoil is stiffened, the mechanical strength thereof is no longer based only on the central portion of the connection airfoil. As a result, the central portion can be further thinned and optimized. The aerodynamic gain and the reinforcement allow the numbers of blades in a blade stage to be reduced.

The invention allows the blading to be reinforced, forming connections between the adjacent lateral branches. The shroud or the shroud segment forms a bridge which connects the ends of the branches within the same blade, or one blade adjacent to another. In this manner, the branches are protected against the vibrations which could damage them.

The presence of branches between an airfoil and a shroud multiplies the anchoring arrangements, the transmission and force distribution zones. The fact that two branches of adjacent blades are connected further allows the forces to be distributed in different blades. Furthermore, providing spacings within a row of connected branches enables the flexibility, the rigidity and the transmission of forces in a blading to be optimized.

The invention allows the number of airfoils which can intercept a member in the event of intake to be increased. The member can be slowed, and can be damped or further divided as a result of the leading edges which have been added. Consequently, the members taken in are reduced further upstream, which allows the downstream elements to be protected. The positioning of the branches at the end of the airfoil enables efficient action against the fragments close to the walls of the fluid channels, locations where the fragments are frequently located as a result of the flow dynamics and/or the inclinations of the channels.

The configuration in which the branches overlap axially allows reinforcements which stiffen the airfoil to be formed. The airfoil can be thinned and made lighter since it is less subjected to the phenomena of torsion. The profiles of the airfoil can be better adapted to the aerodynamic requirements. This configuration reinforces the connections between the branches, which makes them more resistant to occurrences of intake.

DRAWINGS

FIG. 8 illustrates a blade according to various embodiments of the invention.

FIG. 9 illustrates a blade according to yet other embodiments of the invention.

FIG. 10 illustrates a blade according to still yet other embodiments of the invention.

DETAILED DESCRIPTION

In the following description, the terms inner or internal and outer or external refer to a positioning relative to the rotation axis of an axial turbomachine.

Figure 1:
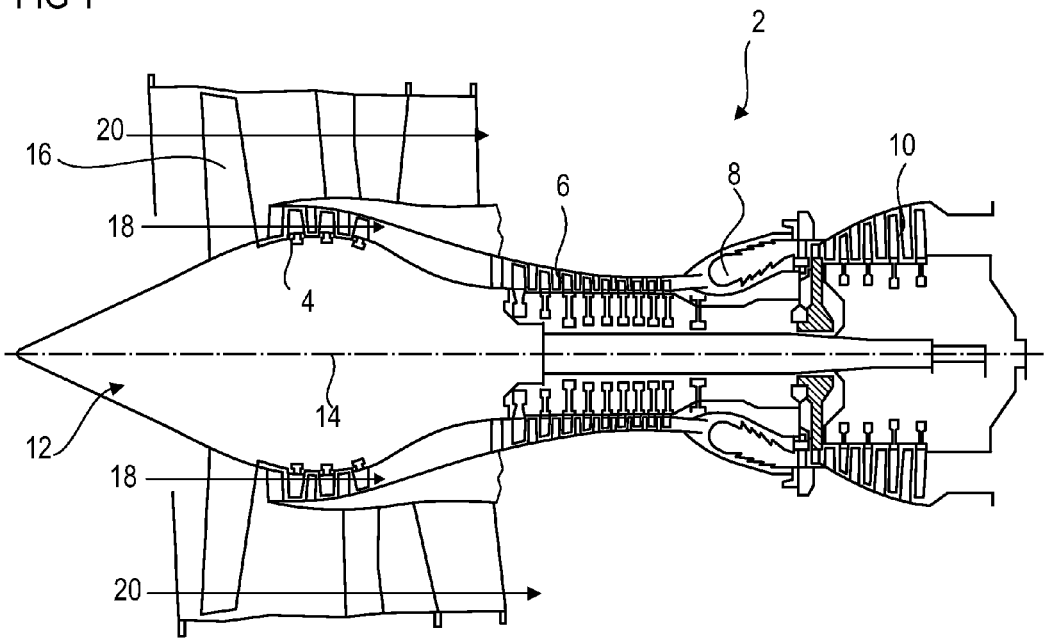
FIG. 1 shows an axial turbomachine according to various embodiments of the invention.

FIG. 1 is a simplified illustration of an axial turbomachine. In this particular case, it is a dual-flow turboreactor. The turboreactor 2 comprises a first compression level, referred to as a low-pressure compressor 4, a second compression level, referred to as a high-pressure compressor 6, a combustion chamber 8 and one or more turbine levels 10. During operation, the mechanical power of the turbine 10 transmitted via the central shaft to the rotor 12 causes the two compressors 4 and 6 to move. The different turbine stages can each be connected to the compressor stages via concentric shafts. These comprise a plurality of rows of rotor blades which are associated with rows of stator blades. The rotation of the rotor about the rotation axis 14 thereof thus allows a flow of air to be generated and allows it to be progressively compressed until it enters the combustion chamber 8.

An inlet ventilator which is generally referred to as a fan or blower 16 is coupled to the rotor 12 and generates a flow of air which is divided into a primary flow 18 which passes through the above-mentioned different levels of the turbomachine, and a secondary flow 20 which passes through an annular conduit (partially illustrated) along the machine in order to then join the primary flow at the output of the turbine. The secondary flow can be accelerated in order to generate a reaction. The primary flow 18 and secondary flow 20 are annular flows, they are channeled by the housing of the turbomachine. To this end, the housing has cylindrical walls or shrouds which can be internal and external.

The turbomachine can comprise a compressor or a portion of compressor in which the flow circulates radially. It can also comprise a similar turbine. The blades, in particular the leading edges and/or the trailing edges thereof, can extend radially or axially.

Figure 2:
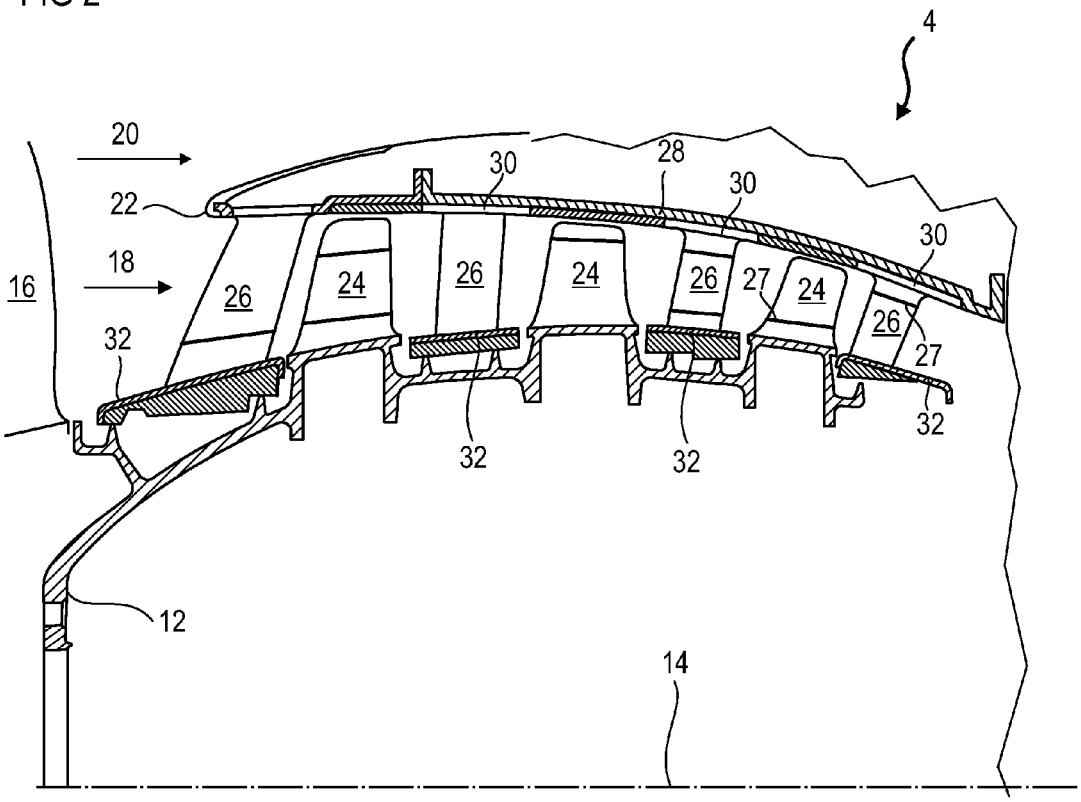
FIG. 2 is a diagram of a turbomachine compressor according to various embodiments of the invention.

FIG. 2 is a sectioned view of a compressor of an axial turbomachine 2 such as that of FIG. 1. The compressor can be a low-pressure compressor 4. It is possible to observe therein a portion of the fan 16 and the separation nose 22 of the primary flow 18 and the secondary flow 20. The rotor 12 comprises a plurality of rows of rotor blades 24, in this instance three.

The low-pressure compressor 4 can comprise a plurality of rectifiers, in this instance four, which each contain a row of stator blades 26. The rectifiers are associated with the fan 16 or a row of rotor blades in order to rectify the flow of air, in order to convert the speed of the flow into pressure.

The stator blades 26 extend substantially over the height thereof through the flow 18, for example radially, from an outer housing 28, and can be fixed at that location using a shaft which can be formed on a fixing platform.

The blades (24, 26) can be fixed individually to the stator or to the rotor 12, or can be grouped in blade arrangements which comprise a plurality of blades which form a row along the circumference. The blades (24, 26) can be grouped in bladed casings, with a plurality of blades and a shroud, or with two concentric shrouds (30, 32) between which the blades (24, 26) extend radially.

A blading can be integral, e.g., it can be in one piece, for example as a result of an additive production method. It can also be produced by welding branches and airfoils to each other.

The rotor blades 24 and/or the stator blades 26 of the compressor can be branched. The branching configurations can vary from one blade row to another and can be branched at the bottom and/or at the top of the blade. The junctions 27 between the branches and the airfoils of the blades can be seen.

Figure 3:
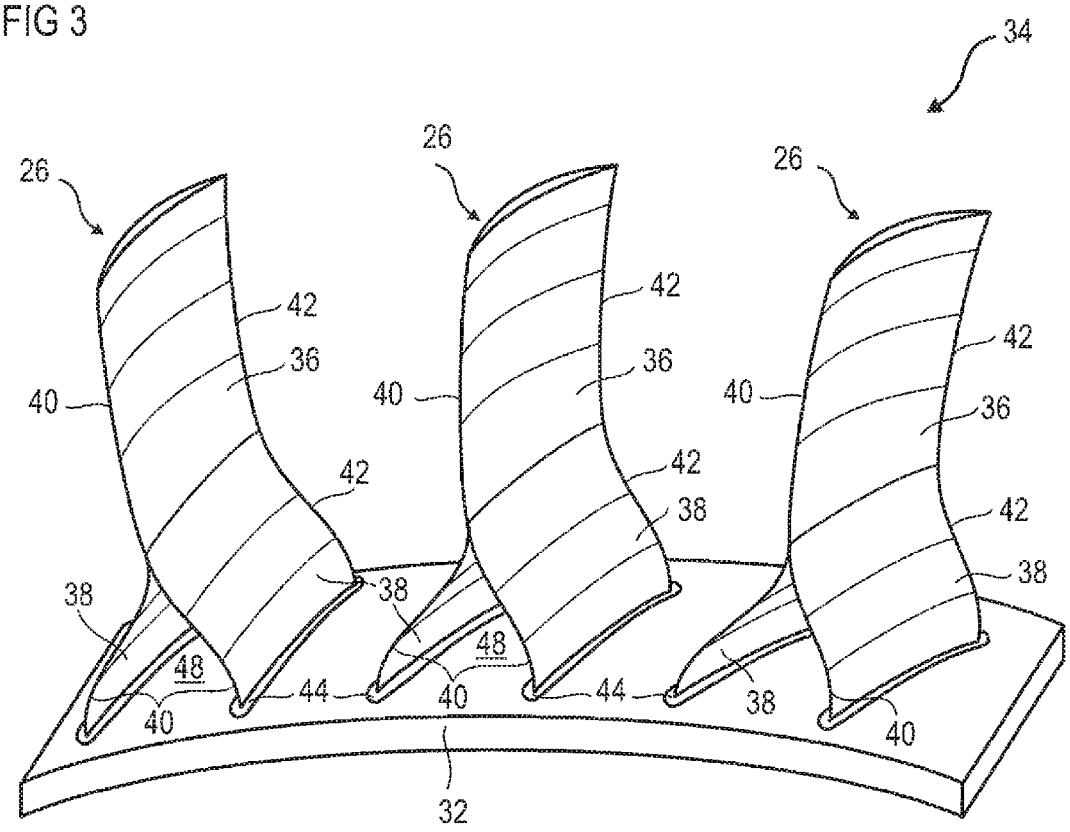
FIG. 3 illustrates a blading according to various embodiments of the invention.

FIG. 3 illustrates a turbomachine blading 34 according to various embodiments of the invention. The blading 34 illustrated is a stator blading, it could also be a rotor blading.

A blading 34 can be understood in the manner of a surface, which can be rigid, which enables a fluid to be guided during flow. It can be understood in the manner of an assembly of blades 26. The blading can be and/or can comprise a row of blades having a plurality of blades 26 which form an annular row portion. The blades 26 are arranged on a wall, such as a shroud or a shroud portion, e.g., an internal shroud portion 32. The wall or shroud portion can be in the form of a circle or circular arc.

Each blade 26 can rise, in various instances extend radially, from the shroud 32. Each blade 26 comprises an airfoil 36 and branches 38. The airfoil 36 can be a connection airfoil 36 which joins the branches 38, the branches being able to be branching airfoils 38. The branches 38 of the same blade are spaced apart from each other in the circumferential direction.

Each airfoil 36 and/or each branch 38 can generally be in the form of a sheet which can generally extend along a main plane, the sheet can be substantially curved inwards and/or have a variable thickness. An airfoil has a leading edge 40 and a trailing edge 42 which delimit an intrados surface and an extrados surface.

The branches 38 can be lateral branches 38, in the sense that they extend laterally away from the airfoil 36 in the direction of the thickness thereof and/or perpendicularly to the chord of the airfoil 36. Each branch 38 has two opposing ends over the height thereof, in various instances radial, of the airfoil. One of the ends is connected to the airfoil 36 and the other is connected to the shroud 32 which forms a support. The shroud 32 and the blades can be integral, or the shroud can comprise openings 44 in which the ends of the branches are fixed and/or sealed.

The shroud 32 can be an external housing portion, or a rotor wall, such as a rotor drum wall. The shroud can form a circle or an angular circle portion such as an arched strip of material.

The height of a branch 38, an airfoil 36 or the blade 26 can be perpendicular to the leading edge and/or the trailing edge of the airfoil, and/or orientated perpendicularly to the fluid. The airfoil and the branches are intended to extend in the flow of the turbomachine.

The branches 38 of the adjacent blades 26 are remote from each other, they enable passage between the blades along the external surface of the shroud 32. In combination with the shroud, the branches of at least one or each blade form a pipe 48 which extends through the blade 26. This pipe 48 is configured to accompany a flow of the turbomachine. The upper ends of the airfoils are free and they form portions.

Figure 4:
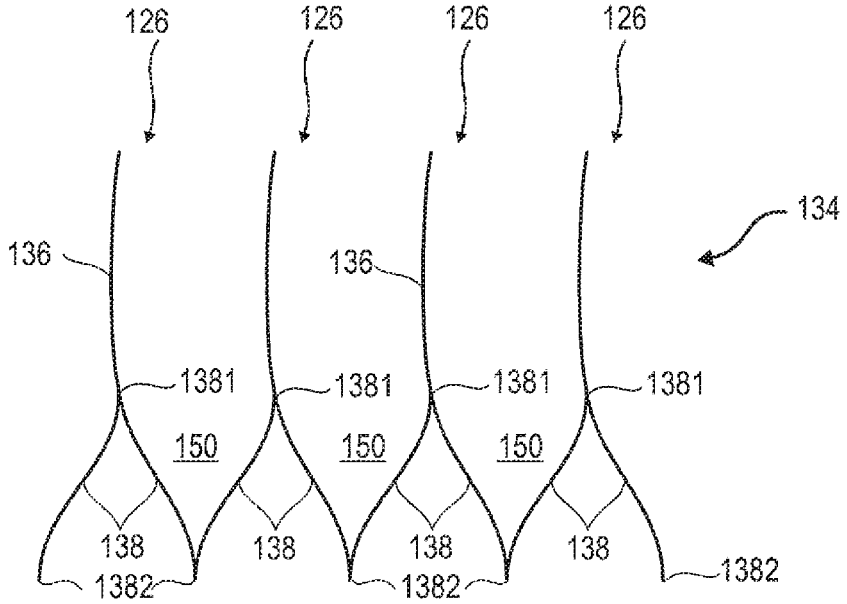
FIG. 4 illustrates a blading according to various other embodiments of the invention.

FIG. 4 shows a blading 134 according to various other embodiments of the invention. This FIG. 4 takes up the numbering of the previous Figures for elements which are identical or similar, but with the numbering being increased by 100. The Figure shows a blade row, in various instances it can include a shroud. Each blade 126 is illustrated in the form of a curve, which can correspond to a leading edge, and/or a trailing edge, and/or a stacking curve of aerodynamic airfoil or branch profiles.

The row comprises a plurality of blades 126, each with branches 138 at the same end or the same side as the airfoil 136. The branches 138 extend over the circumference in the direction of the adjacent blade 126, and in particular the branches 138 of the adjacent blades. The adjacent branches 138 of two adjacent blades 126 are connected, for example, to a radial end 1382 of the blade, such as the opposing end to the one 1381 which receives the airfoil. In this manner, the blades 126 form, with continuity of circumferential material, a chain of blades which are connected to each other by means of their branches 138.

The term "connected" is intended to be understood to mean that the branches 138 or the branch airfoils 138 comprise connecting or merging edges. At the junction of the branches, the total thickness can be less than the total of the thicknesses of each branch.

At least two or each pair of adjacent branches 138 of adjacent blades 126 can form between them a channel 150. A channel 150 can be understood to be an elongate depression, such as a passage which is delimited laterally between two opposing branch walls.

Figure 5:
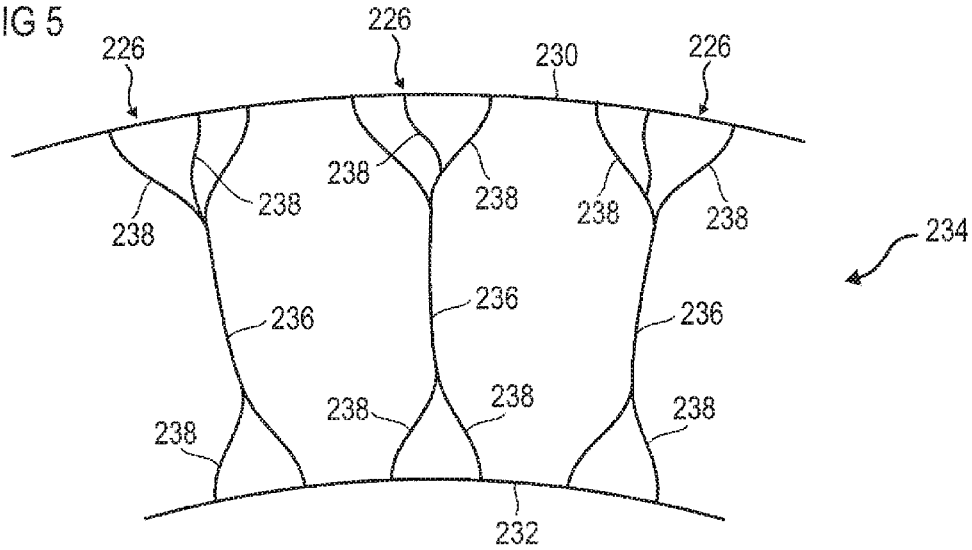
FIG. 5 illustrates a blading according to yet other embodiments of the invention.

FIG. 5 shows a blading 234 according to a yet other embodiments of the invention. This FIG. 5 takes up the numbering of the preceding Figures for elements which are identical or similar, but with the numbering being increased by 200.

The blading 236 comprises a row of blades 226 with a plurality of blades which form an angular portion of an annular row. The row can form a circle. The blades 226 are arranged on a wall, such as a shroud (230, 232) or a shroud portion. The wall or shroud portion can be in the form of a circle or circular arc.

The blading can be a bladed casing. It can comprise at least three blades 226 each with an airfoil and branches which extend the airfoil over the radial height of the airfoil. The blades, including their branches, can be remote from each other.

The blading 236 comprises two shroud segments, such as an inner shroud segment 232 and an outer shroud segment 230 which can be understood to be angular sectors of tubes. The segments are concentric, and define a fluid channel whose centre over the radial height is located in the region of the airfoil, e.g., at mid-height.

At least one or each blade 226 can comprise two sets of branches 238 which are each joined to an end of the airfoil 236 and to a shroud segment (230, 232). In this manner, the shroud segments are connected to each other via, in this order, first sets of branches 238, airfoils 236, second sets of branches 238. Each branch is joined to the blade and/or to a shroud over the majority, e.g., over the whole, of the length thereof.

The sets of branches 238 of at least one blade or each blade can have different numbers of branches. In various embodiments, the sets which have the most branches 238 are at the same side of the airfoil 236. The arrangements of branches can vary from one adjacent set to another.

For example, a set can comprise at least three branches, including two side branches 238 over the circumference, between which at least one central branch 238 is arranged. These branches 238 can all be connected, each having a connection edge; the edges being merged. In various embodiments, at least one or each blade 226 has branches 238 which are connected at different heights of the airfoil 236. A branch 238 can extend from another branch 238 so as to remain remote from another branch and/or the airfoil 236. Such a branch 238 can form a stand which stiffens the blading 234. A branch 238 can extend laterally at one side of the airfoil 236, then the other, or can extend only at one side of the airfoil 236.

Figure 6:
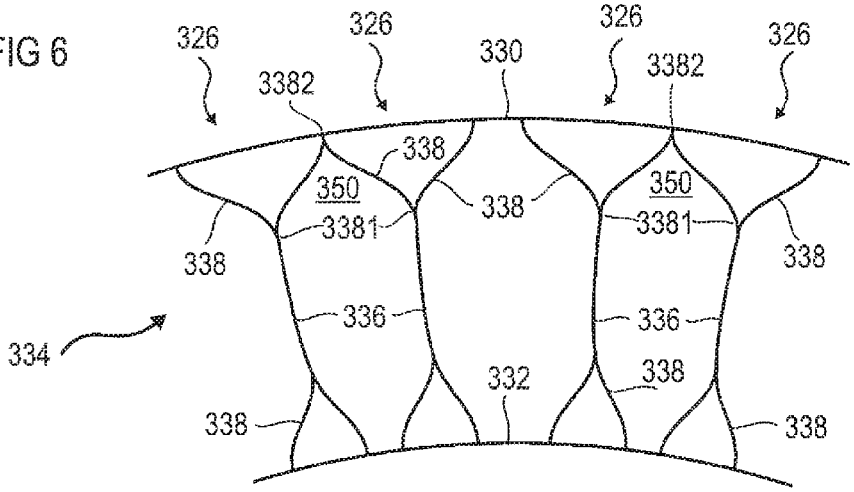
FIG. 6 illustrates a blading according to still other embodiments of the invention.

FIG. 6 shows a blading 334 according to still other embodiments of the invention. This FIG. 6 takes up the numbering of the preceding Figures for elements which are identical or similar, but with the numbering being increased by 300. The blading illustrated is a stator blading, alternatively it could be connected to the rotor.

The blading 334 comprises a plurality of sets of blades. Each set can form an angular portion of an annular row of blades. Each set of blades comprises a plurality of blades 326, each with an airfoil 336 and branches 338 which extend the airfoil 336 over the height thereof, e.g., the radial height. Each blade 326 can comprise two sets of branches. At one side radially, adjacent branches 338 of a set of blades 326 can be connected, at the other side the branches 338 remain spaced apart. The branches have two ends 3381, 3382 for the connection to each other and to the airfoil. The sets of blades can be remote from each other. In particular, the branches of a set of blades can be spaced apart, along the circumference, from each branch 338 of a set of adjacent blades.

Figure 7:
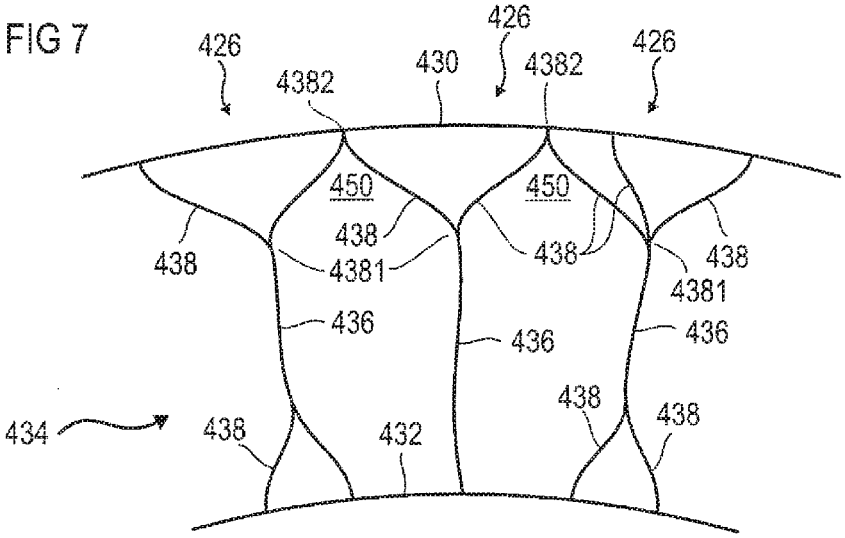
FIG. 7 illustrates a blading according to still yet other embodiments of the invention.

FIG. 7 shows a blading 434 according to still yet other embodiments of the invention. This FIG. 7 takes up the numbering of the preceding Figures, for elements which are identical or similar, but with the numbering being increased by 400. Specific numbers are used for the elements specific to this embodiment.

The blading 434 comprises a row of blades 426 which form at least a portion of an annular row of a turbomachine. The blades 426 are arranged on a wall, such as a shroud or a shroud portion (430, 432). The wall or shroud portion can be in the form of a circle or circular arc.

The row can have a mixed arrangement of blades 426. Some blades 426 can be free of branches at least at one end or at each end. The number of branches 438 at the same radial side of the blading can vary between the blades 426. Some, or all, of the adjacent branches 438 of different blades 426 can be connected. The branches have two ends 4381, 4382 for the respective connection to each other and to the airfoil. At one radial side of the blading, the branches can form a row and/or can be connected to each other in order to form a chain of branches 438 which can also be connected to a shroud 430 in addition to the associated airfoils 436. This double connection of the branches stiffens the shroud and therefore the blading against forces of torsion.

FIG. 8 shows a blade 526 according to various other embodiments of the invention. This FIG. 8 takes up the numbering of the preceding Figures for elements which are identical or similar, but with the numbering being increased by 500. Specific numbers are used for the elements specific to this embodiment. The blade 526 can be a stator blade 526 as illustrated in FIG. 2.

The blade 526 comprises an airfoil 536 and at least two branches 538, e.g., three or more branches 538. The airfoil 536 can be a connection airfoil 536 or a main airfoil 536, in the sense that the height and/or the thickness thereof is greater than that of each branch 538. The connection airfoil 536 forms a connection portion 552 and the branches 538 form a branched portion 554, the portions being superimposed along the height.

The branches 538 can be branching airfoils 538 which are connected by the connection airfoil 536. To this end, they can comprise connection edges which are at least partially, e.g., completely, merged along the chord of the connection airfoil. The connection edges 556 can form ends, delimitations of the branching airfoils 538. The connection airfoil 536 and the branching airfoils 538 are intended to each be arranged in the flow of the turbomachine.

The connection airfoil 536 is arranged in the extension of the branching airfoils 538 at the junction thereof. The connection airfoil 536 can form the connection between the branching airfoils 538. They can form divisions of the connection airfoil. They can form branches 538 which become separated from the connection airfoil in the region of a junction. The connection airfoil 536 can be divided, split into branching airfoils. The branches can be secured to each other and/or one on the other.

The connection airfoil 536 and/or each branching airfoil 538 can comprise a leading edge 540, a trailing edge 542. The connection airfoil and/or each branching airfoil can comprise an intrados surface and an extrados surface which extend from the leading edge 540 to the corresponding trailing edge 542. The intrados surface and the extrados surface of the connection airfoil is tangential, in various instances along the entire chord thereof, to the adjacent surfaces of the branching airfoils 538.

The connection airfoil 536 and/or each branching airfoil 538 can comprise aerodynamic profiles 558, which can be cambered and which are stacked over the height, e.g., the radial height. The centres of gravity of the aerodynamic profiles 558 of the connection airfoil 536 and/or each branching airfoil 538 can describe a stacking curve 560. The stacking curves 560 of the branching airfoils 538 can be in the radial and/or axial and/or circumferential extension of the stacking curve 560 of the connection airfoil 536, in various instances being progressively offset. The branching airfoils can define between them a channel 562, in various instances remote from the connection airfoil 536. The height H1 of the connection airfoil 536 can be greater than or equal to the height H2 of each branching airfoil 538.

The leading edges 540 and/or the trailing edges 542 and/or the stacking curves 560 of each branching airfoil 538 can have a variation, e.g., an increase, and/or an inversion of curvature relative to the leading edge 540 and/or the trailing edge 542 and/or the stacking curve 560 of the connection airfoil 536, respectively.

The maximum thickness of the aerodynamic profiles 558 of the connection airfoil 536 can be greater than the maximum thickness of the aerodynamic profiles 558 of each branching airfoil 538. The surface of each aerodynamic profile 558 of the connection airfoil can be greater than or equal to the surface of each aerodynamic profile of at least one or each branch. The total of the surfaces of the aerodynamic profiles of the branches at a specific height can be greater than or equal to the surface of each aerodynamic profile of the airfoil.

The blade 526 comprises at least two branching airfoils 538, e.g., three or four, or even more at the same end. The blade 526 can comprise a support 564 which is connected to the branching airfoils. In various instances, the support 564 is a fixing platform 564, for example, provided with a fixing shaft 566. The branching airfoils 538, the connection airfoil 536, and in various instances the support 562 can be integral. They can be produced by means of additive production with a titanium powder.

At least one or each branching airfoil 538 can comprise portions, over the height of the blade, which are inclined relative to each other. These portions can be curved, and have variations, or inversions of curvature. Over the height thereof, the mean axis of the stacking curve 560 of at least one or each branching airfoil 538 is inclined relative to that of the connection airfoil 536. These geometries can be observed in the region of the leading edge 540 and/or the trailing edge 542 and/or the stacking curve 560 of the profiles 558.

The spacing E between the branching airfoils 538, measured opposite the connection airfoil 536, in the region of the leading edges 540 thereof, or in the region of the trailing edges 542 thereof, or in the region of the maximum passage width is greater than the majority of the mean or maximum thickness of the connection airfoil 536. The spacing E can be less than the length L of the branching airfoils 538 and/or less than the height H2 of the branching airfoils. For at least one or each branching airfoil 538, the length L can be greater than or equal to the height H2.

FIG. 9 shows a blade 626 according to still yet other embodiments of the invention. This FIG. 9 takes up the numbering of the preceding Figures for elements which are identical or similar, but with the numbering being increased by 600. Specific numbers are used for the elements specific to this embodiment.

The blade 626 comprises two branched portions 654 which are connected by means of a connection portion 652. The connection airfoil 636 of the blade 626 comprises two opposing ends 668 over the height thereof, for example, radial ends, such as a head and a foot. The connection airfoil 636 can comprise branching airfoils 638 at each of the radial ends thereof, the branching airfoils forming a first set and a second set of branching airfoils 638, each set being connected to one of the ends 668 of the connection airfoil 636. The height H2 of the branching airfoils can vary from one set to another and can remain lower than the height H1 of the connection airfoil 636.

Ends of branching airfoils can be free portions 670. They can form portions in the form of aerodynamic profiles of cambered blades. The ends can have a fixing means, such as fixing shafts. The ends at the same blade end can each comprise a fixing hole 672, the holes 672 can be aligned in accordance with the row which the associated branching airfoils form.

FIG. 10 shows a blade 726 according to yet still other embodiments of the invention. This FIG. 10 takes up the numbering of the preceding Figures for elements which are identical or similar, but with the numbering being increased by 700. Specific numbers are used for the elements specific to this embodiment.

The blade 726 comprises a connection airfoil 736 with two opposing ends 768 over the height H1, each end 768 comprising branches 738 which extend the airfoil in the direction of the height. The branches form a first set of branches at one end 768 of the airfoil 736, and a second set of branches 738 at the other end 768. The opposing ends 768 comprise a different number of branches 738.

The sets of branches can be superimposed over the height of the blade 726 and are separated by the airfoil 736. One of the sets can cover the other set, the covering being able to be in accordance with the mean chord of the airfoil and/or the thickness of the airfoil.

A set of branches can be connected to a support 764, such as a fixing platform 764. The set of branches at the side opposite the support 764 can have free edges 770, and in various instances a fixing means 774 such as projections 774 or rough portions 774. These means can be used to seal the branches to a wall, a support or a shroud.

The various embodiments of the blades described and illustrated with regard to FIGS. 3 and 7 can be in accordance with the various embodiments described and illustrated with regard to FIGS. 8, 9 and 10. A blading can comprise branches at each end, over the height of the airfoils. The number of branches can be different at each of these ends. The various embodiments of the blades described and illustrated with regard to FIGS. 9 and 10 can take up the configurations of the blade described and illustrated with regard to FIG. 8, in particular in terms of everything relating to the arrangement of the leading edges, the trailing edges, the edges of the connections, the stacking curves, the arrangement of the branching airfoils in relation to the connection airfoil.

What is claimed is:

1. A blade of an axial turbomachine, said blade comprising:

an airfoil which extends radially and which has two radially opposing ends;

a first set of branches which radially extend one of the ends of the airfoil; and a second set of branches which radially extend the other of the two radially opposing ends of the airfoil, wherein the first set of branches and the second set of branches comprise different numbers of branches.

2. The blade in accordance with claim 1, wherein in each set of branches, the branches are offset relative to each other over a circumferential direction.

3. The blade in accordance with claim 1, wherein opposite the airfoil, each branch of at least one set of branches comprises a free edge.

4. The blade in accordance with claim 1, wherein at least one branch of the first set is superimposed radially on at least one branch of the second set, the superimposed branches being connected by the airfoil.

5. The blade in accordance with claim 1, wherein the airfoil comprises a pressure side and a suction side, each set of branches comprising at least one branch placed on a same lateral side of the blade, the branches being connected by the airfoil.

6. The blade in accordance with claim 1, wherein the branches of the first set extend at each side of the airfoil and completely cover the branches of the second set.

7. The blade in accordance with claim 1, wherein the first and second sets of branches form rows of branches which are generally parallel, the branches of each set comprise mutually opposing faces.

8. The blade in accordance with claim 1, wherein one of the first and second sets of branches comprises more branches than the other one of the first and second sets of branches, wherein the branches of the one of the first and second sets of branches comprising more branches are connected at different radial heights, and the branches of the one of the first and second sets of branches which has more branches are less thick than the branches of the other one of the first and second sets of branches.

9. The blade in accordance with claim 1, wherein at least one branch of the first and second sets of branches extends in the radial direction of the airfoil and the branches of the first and second sets of branches at each end of the airfoil are generally inclined with respect to each other.

10. The blade in accordance with claim 1, wherein the airfoil extends in an axial direction perpendicular to the direction of a radial extension of the airfoil, wherein the branches of at least one of the first and second sets of branches are integral to the airfoil along more than half of an axial length of the airfoil.

11. An axial turbomachine blading, said blading comprising:

at least two adjacent blades, each blade comprising:

an airfoil which extends radially and which has two radially opposing ends; and a first set of branches which radially extend one of the radially opposing ends of the airfoil, wherein at least two branches of the at least two adjacent blades being coincident so as to join the at least two adjacent blades via their coincident branches in a junction, wherein each of the branches of the first set of branches has a thickness and the junction has a thickness that is less than a sum of the thickness of the first set of branches that are joined at the junction.

12. The axial turbomachine blading in accordance with claim 11, wherein each branch comprises a first radial end and a second radial end radially opposite to the first radial end, the first radial ends being joined to the airfoils, the second radial ends being joined together and forming an arcuate row.

13. The axial turbomachine blading in accordance with claim 12, wherein the blading forms at least a portion of an annular blade row or an annular row.

14. The axial turbomachine blading in accordance with claim 12, wherein each blade further comprises a second set of branches, at least two branches of the second set of branches of the at least two adjacent blades being coincident so as to join the at least two adjacent blades via their coincident branches, the at least two adjacent blades embracing a channel by means of their airfoils and their coincident branches.

15. A turbomachine, said turbomachine comprising:

an axial direction, a radial direction and a circumferential direction;

at least one row of blades, at least one blade of the row or blades comprising:

an airfoil which extends radially and which has two radially opposing ends;

a first set of branches which radially extend one of the radially opposing ends of the airfoil, and a second set of branches which radially extend the other of the radially opposing ends of the airfoil, wherein the branches of the second set being offset relative to each other over the circumferential direction of the turbomachine, wherein the airfoil extends radially from a radially inner end to a radially outer end, and wherein the turbomachine comprises two branches of the first set of branches at the radially inner end of the airfoil and three branches of the second set of branches at the radially outer end of the airfoil, the first and second sets of branches, each having different spacing between their branches.

16. The turbomachine in accordance with claim 15, wherein the at least one row of blades comprises two concentric shrouds and a plurality of blades extending radially between the shrouds, the shrouds being connected to each other via each set of branches.

* * * * *